US006943653B2

(12) United States Patent
Hanke et al.

(10) Patent No.: US 6,943,653 B2
(45) Date of Patent: Sep. 13, 2005

(54) BISTABLE ELECTRIC SWITCH AND RELAY WITH A BI-STABLE ELECTRICAL SWITCH

(75) Inventors: Martin Hanke, Berlin (DE); Matthias Kroeker, Ragow (DE); Thomas Haehnel, Berlin (DE); Joerg Schultheiss, Potsdam (DE)

(73) Assignee: Tyco Electronics Amp GmbH, Bensheim (DE)

( * ) Notice: Subject to any disclaimer, the term of this patent is extended or adjusted under 35 U.S.C. 154(b) by 73 days.

(21) Appl. No.: 10/311,402

(22) PCT Filed: Jun. 19, 2001

(86) PCT No.: PCT/IB01/01066

§ 371 (c)(1),
(2), (4) Date: Mar. 17, 2003

(87) PCT Pub. No.: WO01/99135

PCT Pub. Date: Dec. 27, 2001

(65) Prior Publication Data

US 2003/0156006 A1 Aug. 21, 2003

(30) Foreign Application Priority Data

Jun. 19, 2000 (EP) ..... 00112917

(51) Int. Cl.[7] ..... H01H 51/22
(52) U.S. Cl. ..... 335/80; 337/123; 200/405
(58) Field of Search ..... 337/123, 140, 337/12, 14; 200/405–408, 447, 449

(56) References Cited

U.S. PATENT DOCUMENTS 3,634,803 A * 1/1972 Willson et al. ..... 337/123
3,872,415 A * 3/1975 Clarke ..... 337/140
3,967,227 A * 6/1976 Clarke et al. ..... 337/124
4,544,988 A * 10/1985 Hochstein ..... 361/211
4,806,815 A * 2/1989 Honma ..... 310/307
5,270,506 A 12/1993 Masoner ..... 200/468
5,410,290 A * 4/1995 Cho ..... 337/140
5,463,514 A * 10/1995 Yaeger ..... 360/254.3
5,618,269 A * 4/1997 Jacobsen et al. ..... 604/118
5,629,662 A * 5/1997 Floyd et al. ..... 337/36
5,977,858 A * 11/1999 Morgen et al. ..... 337/140
5,990,777 A 11/1999 Whiteman, Jr. ..... 337/140
6,016,096 A * 1/2000 Barnes et al. ..... 337/123
6,049,267 A * 4/2000 Barnes et al. ..... 337/123
6,133,816 A * 10/2000 Barnes et al. ..... 337/123

FOREIGN PATENT DOCUMENTS

EP 0 145 204 A1 6/1985 ..... H01H/61/01
FR 2 225 828 11/1974 ..... H01H/61/04
GB 696816 9/1953

OTHER PUBLICATIONS

See PCT International Search Report for any references that are not enclosed herewith.

* cited by examiner

*Primary Examiner*—Lincoln Donovan
*Assistant Examiner*—Bernard Rojas

(57) ABSTRACT

The invention relates to a bi-stable electric switch comprising a spring (101) that is configured as a bi-stable snap-action spring and carries contact elements (114, 116) on the carrier strip (104) of the spring and comprising at least one drive element made from shape memory material per switch state for actuating the spring, the spring having a plate (110) that is rigidly fixed at one end (102) and that is subjected to a pressure in the direction of its linear extension and evades this by bulging towards one side into one of two stable final states, the regions of the spring in the stable final states taking up different lateral positions and the drive elements (118, 119) acting upon the free end of the plate and as a result of the tilting of free end (104) cause it to snap into the second stable final state.

11 Claims, 7 Drawing Sheets

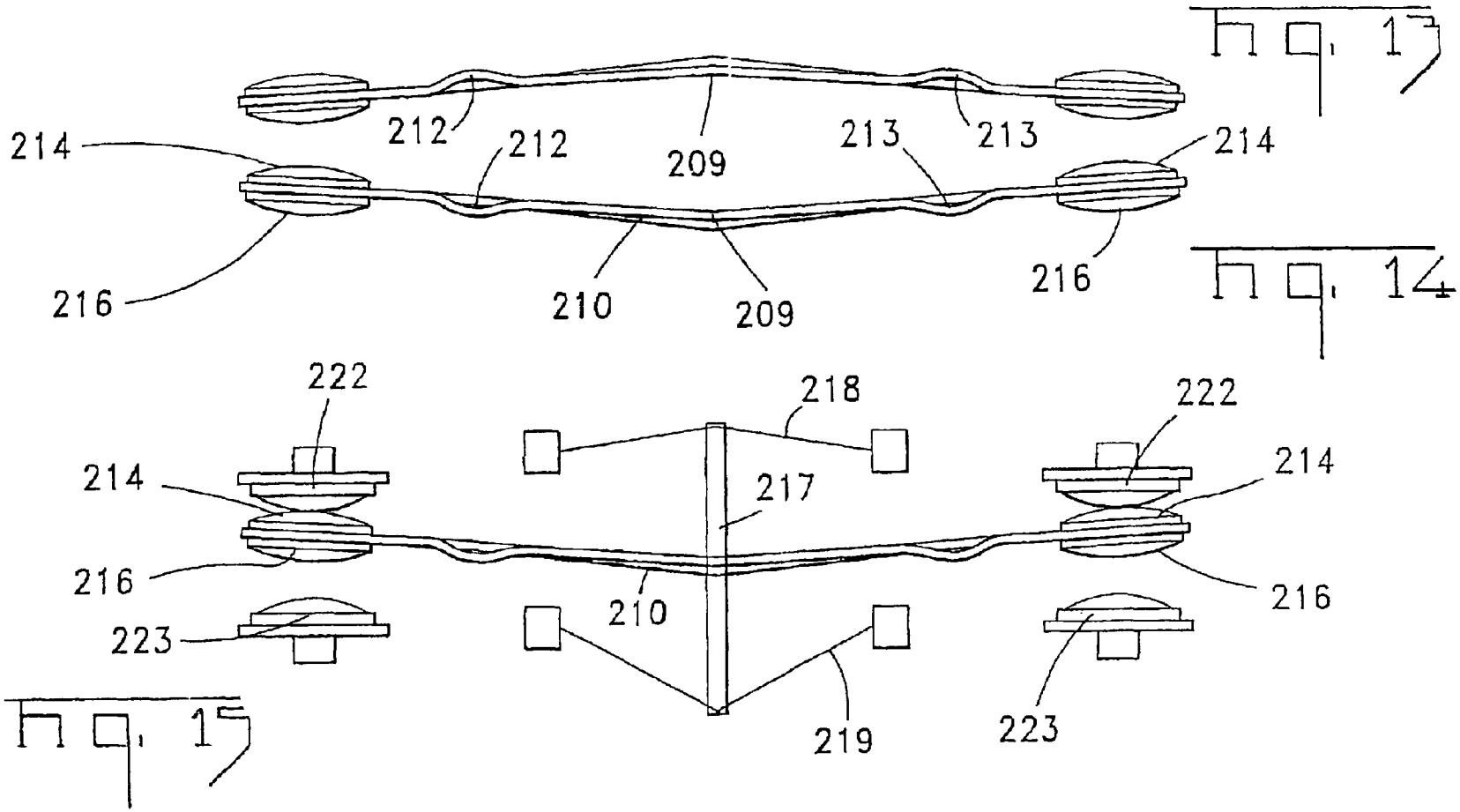
13
14
15
209
210
212
213
214
216
217
218
219
222
223

BISTABLE ELECTRIC SWITCH AND RELAY WITH A BI-STABLE ELECTRICAL SWITCH

FIELD OF THE INVENTION

The invention relates to a bi-stable electric switch comprising a spring that is configured as a bi-stable snap-action spring and carries contact elements on at least one region of the spring and comprising at least one drive element made from shape memory material per switch state for actuating the spring. In addition the invention relates to a relay with such a bi-stable electric switch.

BACKGROUND OF THE INVENTION

A switch consisting of a drive element, a spring contact and first and second wires made from shape memory material as well as first and second contact elements is known from U.S. Pat. No. 5,990,770. The drive element has a substantially T-shaped configuration and is pivoted at the foot of the T. Wires made from shape memory material are arranged at both ends of the cross of the T, the length of which changes depending on the temperature, it being possible to change the temperature by means of a current flowing through the wires. As a result heating due to the flow of current, the wires are transferred from a first phase into a second phase. The first contact element is connected to the spring contact, while the second contact element is rigid. The spring is a bi-stable snap-action spring which, actuated by the drive element, is transferred from a first stable final state into a second stable final state. The spring itself is divided into three regions by means of a U-shaped slot, the outer regions being connected to the middle freely cut tongue by means of a U-shaped spring. The drive element has an effect on the middle tongue only and, as a result of the movement of the middle tongue, the whole spring is moved backwards and forwards between two stable final states because of the effect of the U-shaped spring.

The disadvantage of this configuration is that it requires a relatively large space, the construction of the spring is extremely complicated and an additional drive element is required.

An object of the invention is to define a bi-stable electric switch, as well as a relay with such a switch, the switch and, in particular, the bi-stable snap-action spring, being very simply constructed. SUMMARY The bi-stable electric switch of the invention uses a bi-stable snap-action spring. This is produced in that a part of the spring, which is thin or narrow in comparison to its characteristic linear extension, in other words a plate, is appropriately subjected to a sufficiently high pressure in the direction of the linear extension of the plate. The plate can then bulge or buckle to relieve the pressure.

The spring carries at least one contact element on at least one region. Lateral movements of the region of the spring which carries contact elements are associated with the buckling movement of the plate. These lateral movements are used to open or close circuits.

The snap-action spring is stable in both final states, that is, small deflections lead to springing back into the same final state. Because of to this it is also possible that the spring can apply static contact forces in both final states.

Actuating the spring to switch from one into the other final state is realized by one or more elements made from shape memory material. These drive elements each have two phases in which they exhibit different mechanical properties.

When the drive elements make the transition from one into the other phase, which is achieved by a rise in temperature, due to the flow of electric current through the drive elements, they work mechanically to switch over the nonlinear spring.

It is of particular advantage that the bi-stable electric switch is very light and can be manufactured economically.

It is furthermore of particular advantage to use a spring working nonlinearly that provides contact forces in both switch states.

It is furthermore of particular advantage that the spring is configured as one piece and can be manufactured particularly easily. This is achieved in that a flat-form spring is used as a nonlinear spring, the longitudinal stress of which is established by plastic deformation of one or more regions thereof.

A particularly advantageous configuration of the flat-form spring has elongated slots by means of which it is subdivided into a plurality of plates. The plates are connected to one another at their ends. It is particularly advantageous to provide two elongated slots. By means of plastic deformation, for example bending, it is possible to shorten one or more plates of the spring. As a result a pressure is exerted on the other plates that are not shortened. These will then bulge or buckle and thereby relieve the pressure. A plastic deformation can also be configured in the form of a stamping and therefore an elongation of one or more plates of the flat-form spring. The elongated plates are then subjected to a pressure which they also relieve by bulging or buckling.

It is furthermore of particular advantage to use a trapezoidal spring as a nonlinear spring, the plates of which widen from the narrow side to the wide side of the trapezoidal spring in a constant ratio. In this case the wide side of the spring can be rigidly fixed. Using this spring form ensures a highly uniform distribution of the load. It is particularly advantageous if the width of the plates has a ratio of 1:2:1.

It is furthermore of particular advantage that the spring can be adjusted with the aid of the bends formed in individual plates of the nonlinear spring. The deflection of the spring is determined by the depth of the bend. The force that is required to switch over from one stable final state into the other stable final state is co-determined by the elastic hysteresis of the bend. As a result of the fact that the trapezoidal spring broadens towards the bottom, the opportunity arises to select the force that is required for the transition from one final state into the other final state independently, of the selected deflection, by changing the position of the bend formed, because a crimp made in the narrow region of the plates leads to a gentler switching action than a crimp made in the wide region of the plates.

It is furthermore of particular advantage that the contact elements can either be electrically connected to the spring or can be connected to the spring by means of an insulating intermediate element. Providing insulating material has the advantage that the switch arc starting from the opening contact no longer has the opportunity to spark over to the opposing fixed contact.

It is furthermore of particular advantage that the spring can be connected to the drive elements made from shape memory material via a lever. In this case at least one drive element is required for each switch state. Wires can be used as a drive element, the wires having different lengths in the two phases. The drive elements are heated by the flow of electric current and thereby transferred into the other phase.

Because the wires are shortened, they exert a dynamic effect on the snap-action spring and transfer it from one stable final state into the other stable final state.

Although the drive elements are heated slowly, the snap-action mechanism ensures that the electrical contacts on the one side are opened quickly, move over to the other side by snap action and the contact force is set up suddenly.

It is furthermore of particular advantage to provide auxiliary contacts which ensure that the flow of current through the wires made from shape memory material is interrupted as soon as the switch-over movement occurs. This enables the wires to be charged with a current which, when flowing continuously through the wires, would lead to destruction of the wires but which, on account of the short duration of the flow of current, does not lead to destruction of the wires. Such high strengths of current in the control circuit allow a quick switch-over, as is typical for relays.

It is of particular advantage to use a switch according to the invention as a relay.

It is furthermore of particular advantage and constitutes a further invention to use the arrangement as a polarity reversing switch. This inventive use of the inventive bi-stable switch is possible as a result of the particular configuration of the snap-action spring and the contact arrangement. In this case it is particularly advantageous to form the snap-action spring from two single springs, which are connected to each other with dimensional stability by means of nonconductive elements, as double electrically separated snap-action springs. The two single springs each constitute the center contact of a changeover switch contact arrangement which move between two fixed contacts.

BRIEF DESCRIPTION OF THE DRAWINGS

Embodiments of the invention will be described hereinafter with reference to the figures.

FIG. 13 shows a side view of the bridge spring in the first stable final state.

FIG. 14 shows a side view of the bridge spring in the second stable final state.

FIG. 15 shows a schematic illustration of the spring in the second stable final state with contacts and drive elements indicated.

DETAILED DESCRIPTION OF THE PREFERRED EMBODIMENT

Figure 1:
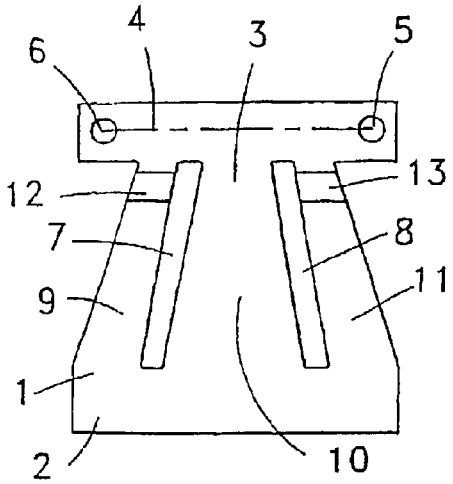
FIG. 1 shows a plan view of a first embodiment of a trapezoidal spring with crimps arranged in the narrow region of the spring.
Figure 2:
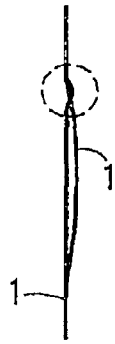
FIG. 2 shows a side view of the spring according to FIG. 1.
Figure 3:
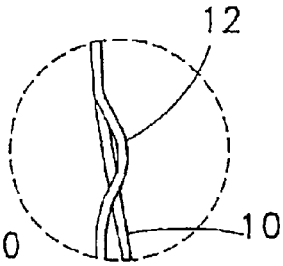
FIG. 3 shows an enlarged detail of the crimp.
Figure 4:
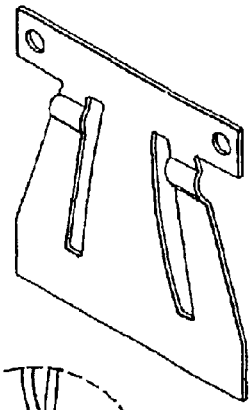
FIG. 4 shows a perspective view of the spring.
Figure 5:
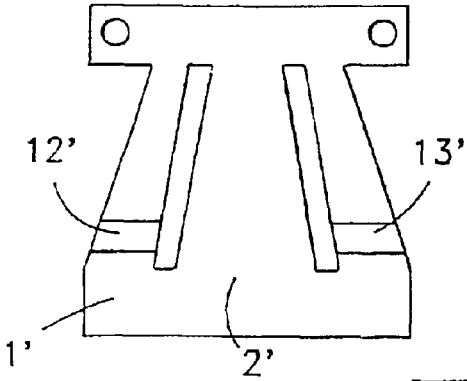
FIG. 5 shows a plan view of a second embodiment of a trapezoidal spring with crimps arranged in the wide region.
Figure 6:
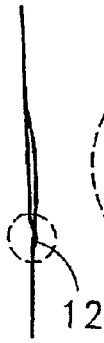
FIG. 6 shows a corresponding side view of this spring.
Figure 7:
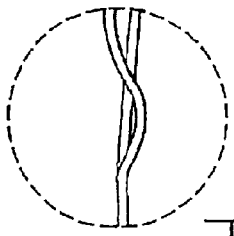
FIG. 7 shows an enlargement of the crimp.
Figure 8:
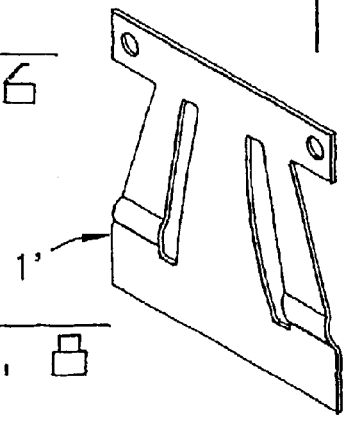
FIG. 8 shows a perspective view of the spring according to FIG. 5.

FIGS. 1 to 4 show a first embodiment of a spring for a bi-stable electric switch according to the invention. Spring 1 is a bi-stable nonlinear snap-action spring that is configured as a trapezoid. It has a wide side 2 as well as a narrow side 3. Again arranged on the narrow side 3 is a carrier strip 4 to which the contact elements are also secured on the regions 5 or 6 by riveting or welding.

The spring is subdivided into three plates 9, 10 and 11 by means of two oblique elongated slots 7 and 8. The plates 9, 10 and 11 are connected to one another at their ends. The lateral plates 9 and 10 are plastically deformed as a result of bending by means of a crimp 12 and 13. The crimp is located near the narrow side 3 of the trapezoidal spring. Because of the crimps 12 and 13, the plates 9 and 11 are shortened and as a result exert a pressure on the middle plate 10. The plate 10 relieves the pressure as it bulges to one side. This can be seen particularly clearly in FIG. 2. The position of the crimp is for example shown particularly clearly in FIG. 3. Because of the position of the crimps 12 and 13 near the narrow end of the trapezoidal spring, a spring is produced that can be switched particularly gently. The force for the transition from one final state into the other final state can be determined by the position of the crimp and as a result of the widening spring. The two final states are defined by the side to which the middle plate 10 bulges.

FIGS. 5 to 8 show a further embodiment of a spring 1' for a bi-stable electric switch according to the invention. The spring 1' differs from the spring 1 of the first embodiment solely as a result of the position of the crimps 12' and 13'. The crimps 12' and 13' of the second embodiment are located near the wide side 2' of the spring. This increases the force required for the switching operation.

The trapezoidal springs shown in the first two embodiments are in each case rigidly fixed with their wide side 2, for example to a housing or base. A wire made from shape memory material is secured on each side of the spring to the carrier strip 4 and, for example, to the housing and, during the transition from one phase into the other phase, is shortened and thereby causes the middle plate to bulge towards one side or the other side and the spring thus to take up one of the two stable final states.

The spring form of the trapezoidal spring with a fixed wide side 2 shown in the first two embodiments leads to a particularly uniform curvature of the spring when loaded.

Figure 10:
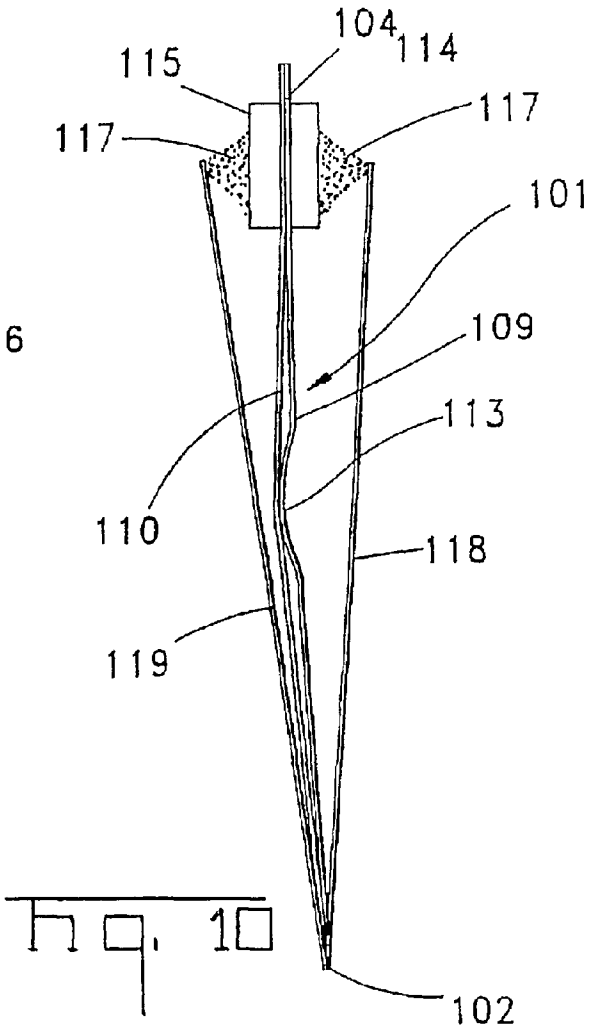
FIG. 10 shows a side view of the spring according to FIG. 9.
Figure 9:
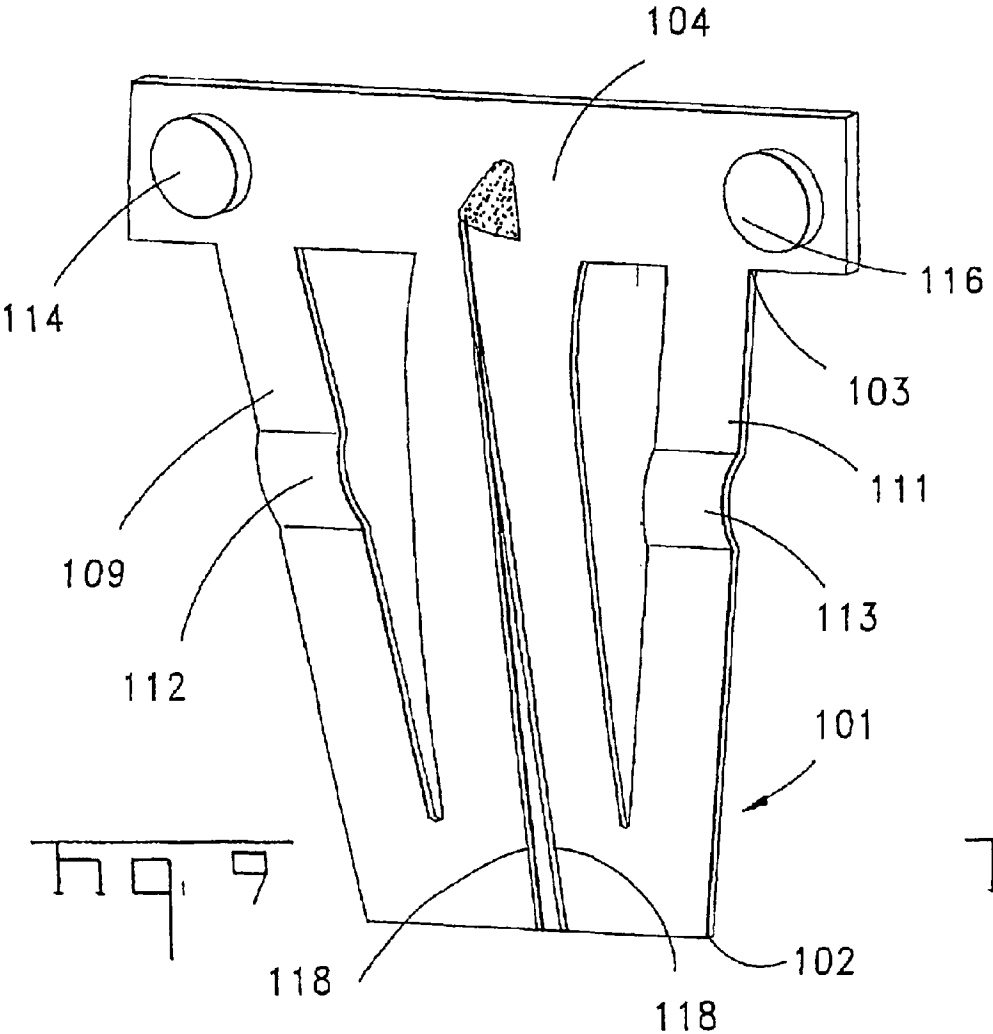
FIG. 9 shows a perspective view of a further embodiment of a trapezoidal spring with crimps and drive elements.
Figure 11:
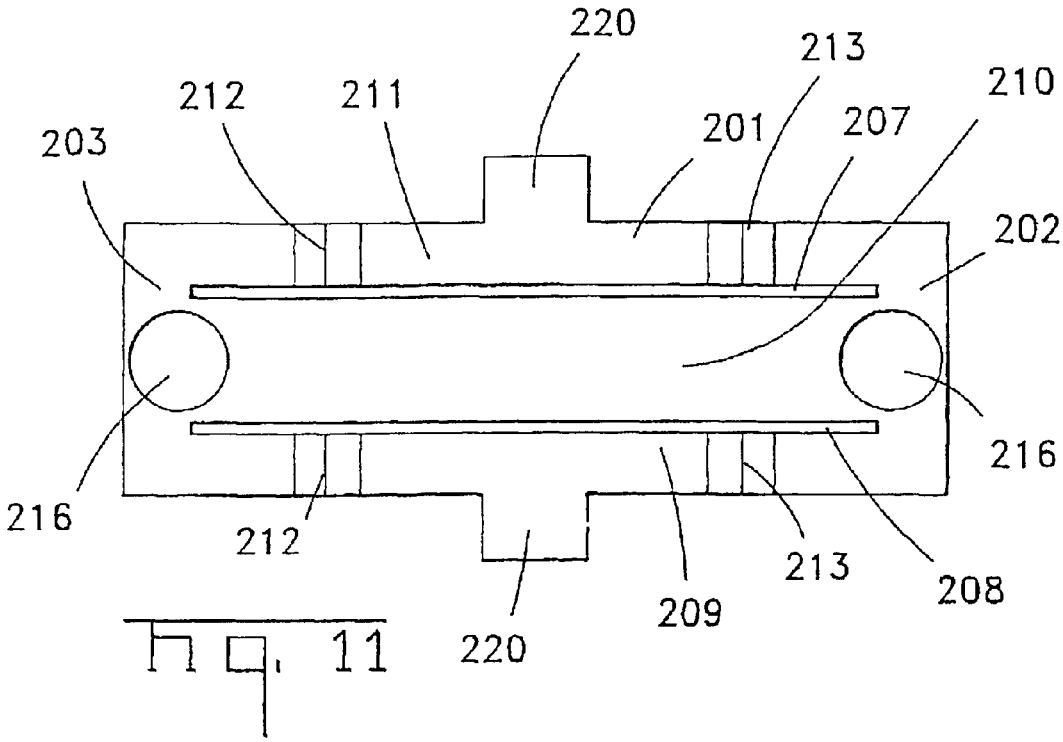
FIG. 11 shows an embodiment of a bridge spring.
Figure 12:
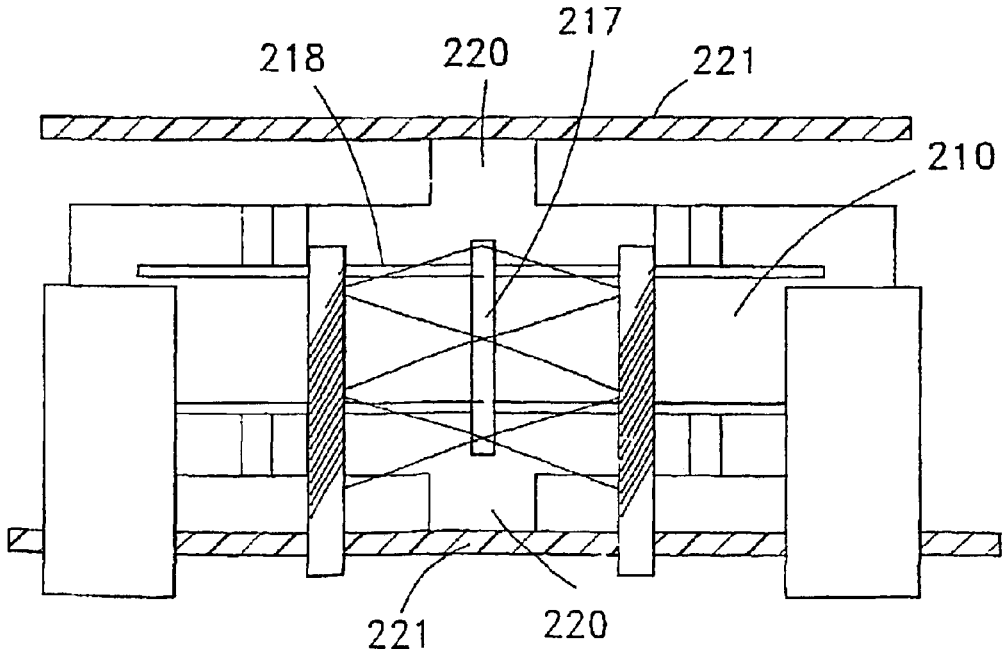
FIG. 12 shows the bridge spring with contacts and drive elements as well as housing indicated.

A trapezoidal spring 101 is also shown in the third embodiment shown in FIGS. 9 and 10; it is, however, rigidly fixed with its narrow side 102. A carrier strip 104 is located on its wide side 103 and carries the contact elements 114, 115 and 116. The trapezoidal spring 101 also has a middle plate 110 as well as two lateral plates 109 and 111 that are in each case shortened by means of a crimp 112 and 113.

There is a short lever arm 117 on the carrier strip 4 on each side. A wire 118 and 119 is sometimes secured to this. If a current flows through such a wire 118 or 119, the wire heats up and as a result enters into its second shortened phase. Because of this shortened phase the carrier strip 114 is then tilted and this tilting causes the bulge of the middle plate 110 to snap over from one side to the other side and as a result the trapezoidal spring 101 is transferred into its second stable final state.

Although the heating occurring when the current flows through the wires takes place comparatively slowly, the snap-action mechanism ensures that the electrical contacts are opened quickly and move over to the other side by snap action and that the contact force on the other side is also set up by snap action.

On the carrier strip 104 it is also possible to secure electrical contact elements 116 on both sides in such a way that opposite contacts are located opposite to them on both sides and, during the switching action of the spring, contacts are opened and closed in pairs in each case. If a current is carried in a load circuit via both contacts, higher direct voltages can also be connected.

When the switch is used as a relay, the opposite contacts will realise the external electrical connection of the relay by means of contact pins. The wires 118 and 119 that are provided on both sides of the spring are also connected to the base of the relay and are guided electrically outwards.

Because the wires 118 and 119 extend obliquely inwards, the contacts are prevented from opening before the spring snaps from one final state into the other.

If a flow of current is carried through the wires made from shape memory material, these heat up and change their phase, which leads to a shortening of the wires. As a result, the upper end of the middle plate is bent elastically around the horizontal transverse axis and the spring snaps into its second stable final state. As a result, in turn, the wires on the other side are stretched so that they are now available for a switching operation in the opposite direction.

A further embodiment of the invention will be discussed hereinafter with reference to FIGS. 11 to 15. This embodiment is a bridge spring 201 that is also configured as a flat-form spring. It has two elongated slots 207 and 208 by means of which it is divided into three plates 209, 210 and 211. The two outer plates 209 and 211 each have two crimps 212 and 213. There are contact elements 216 and 217 located on both free ends 202 and 203 on both sides. The outer plates 209 and 211 have lateral carrier strips 220 with which they are arranged on the housing 221. In the middle region, acting upon the middle plate 210, is a drive element that is connected to the wires 218 and 219 made from shape memory material. If a current is conducted through the wires 218, these are shortened and the drive element 214 is moved perpendicularly to the longitudinal axis of the middle plate 210, thereby triggering a deflection of the middle plate 210 in the other bulge direction and a snapping movement of the snap-action spring into this second final state.

FIGS. 13 and 14 show the two stable final states of the bridge spring. FIG. 15 shows the bridge spring in a stable final state, the opposite contacts 222 and 223 also being shown.

Figure 16:
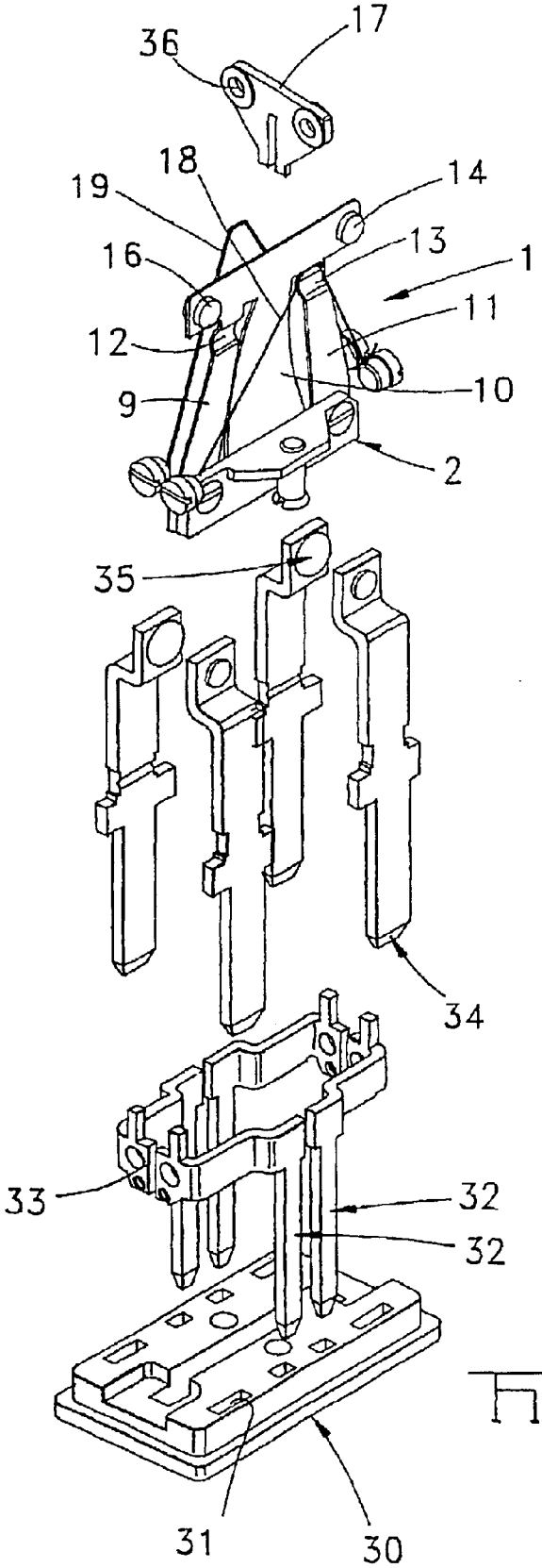
FIG. 16 shows an exploded view of a switch without housing cover using the spring according to FIG. 1.
Figure 17:
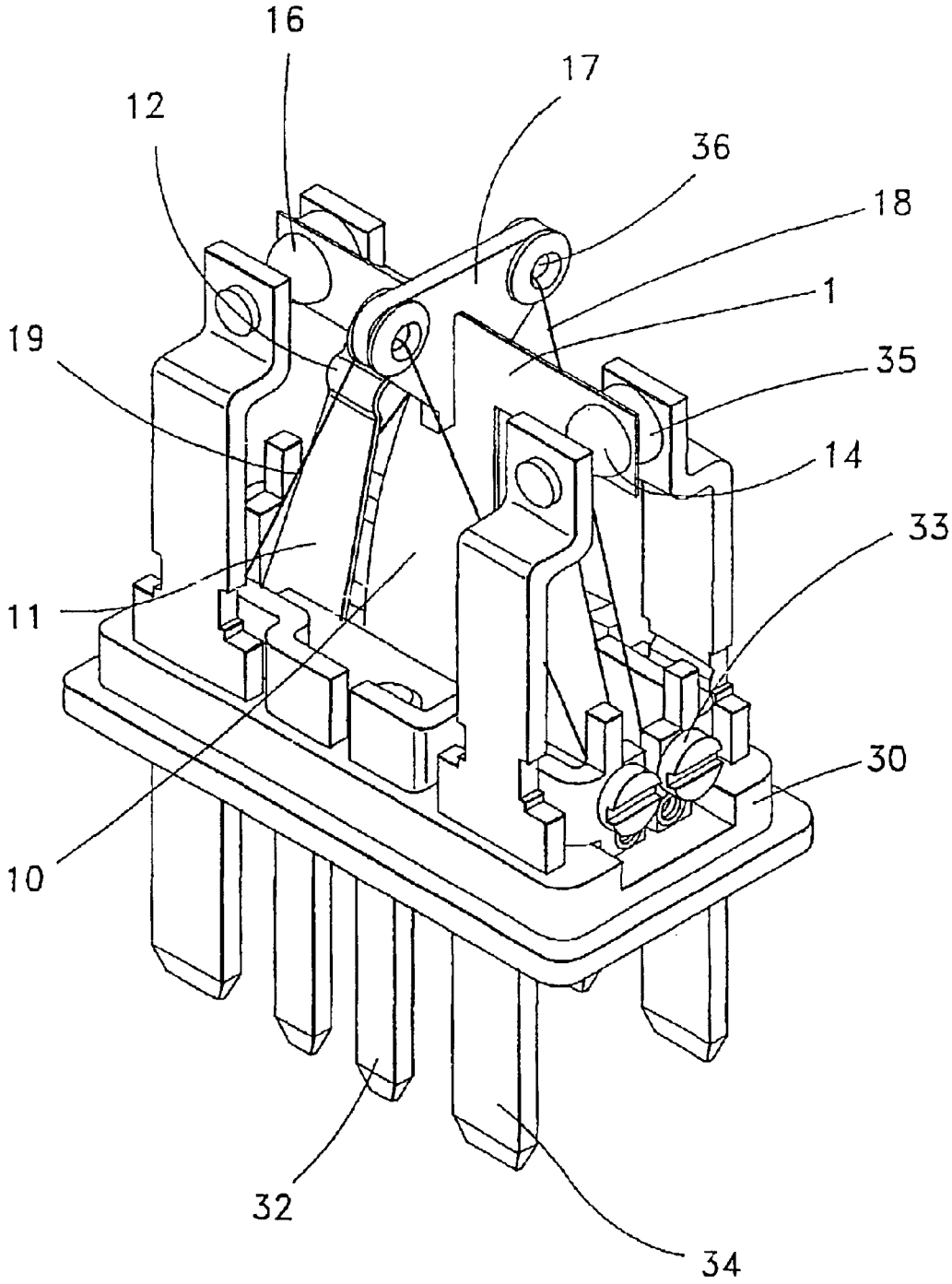
FIG. 17 shows a perspective view of the switch according to FIG. 16.

Referring to FIGS. 16 and 17, a relay will now be described in which the spring 1 of the first embodiment according to FIGS. 1 to 4 is used.

There is a base 30 made from plastics material in which the spring 1 with the end 2 is housed. The base 30 has openings 31 through which the contact pins 32 and 34 travel through the base 30.

The contact pins 32 are connected to the holding devices 33 for the wires 18, 19.

The contact pins 34 are connected to the fixed contact elements 35.

The wires 18, 19 are connected to the spring 1 via the lever arm 17. The wires 18, 19 are in each case guided through a hollow rivet 36 on the lever arm 17.

Figure 18:
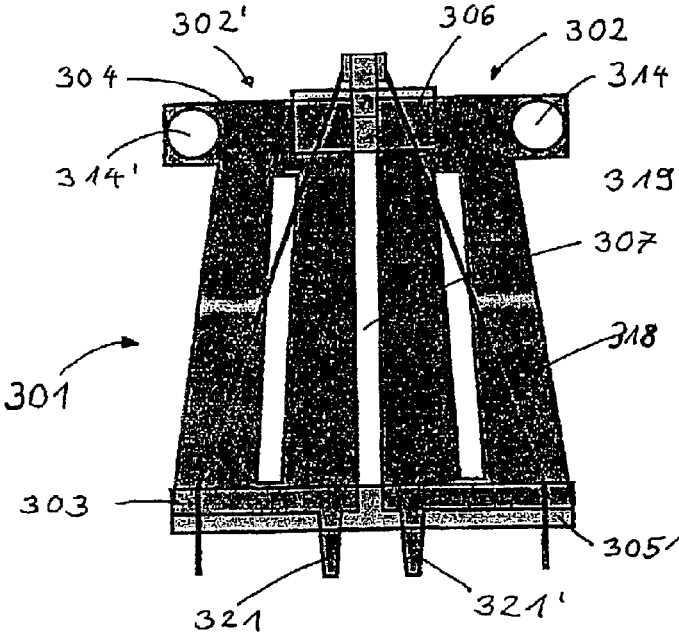
FIG. 18 shows a side view of an embodiment of a double electrically separated snap-action spring with crimps and drive elements.
Figure 19:
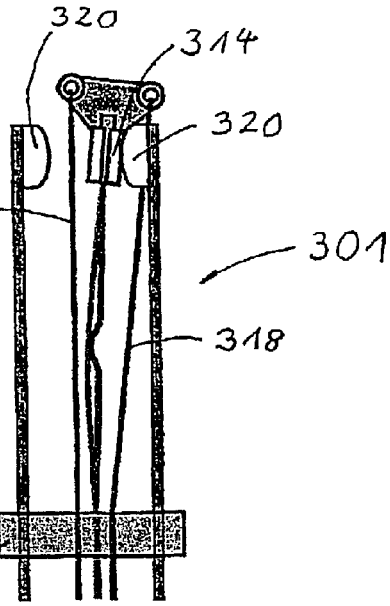
FIG. 19 shows a further side view rotated by 90° of the snap-action spring according to FIG. 18 with fixed contacts.

A switch according to the invention that can be used as a polarity reversing switch is described with reference to FIGS. 18 to 21. FIGS. 18 and 19 show an embodiment of a double electrically separated snap-action spring 301 with crimps and drive elements in two side views from directions perpendicular to each other.

The nonlinear snap-action spring 301 consists of two single springs 302, 302' that are connected with dimensional stability to each other at both the bottom and the top ends 303, 304 by elements 305, 306 made from nonconductive material. The two single springs 302, 302' are arranged together identically and mirror-inverted to each other with respect to their linear extension. Between them there is a gap 307 which is bridged by the said nonconductive connecting elements 305, 306.

The two single springs are, for example, rigidly connected to the underside by means of extrusion-coating or hot stamping with plastics material over the entire width. The two single springs are connected to each other at the top by means of an optionally heat-resistant plastics material, e.g. LCP. This connection can simultaneously be configured as an attachment element for the drive elements or actuators.

Each single spring 302, 302' is made from a material that is both conductive and has spring properties. The spring can be manufactured from a copper alloy with good spring properties, e.g. from $CuBe_2$ spring steel plate. The snap action of the single springs 302, 302' results from the fact that they consist of at least two elongate parts (plates) with different lengths that are connected to each other at both end faces. The resulting stress ensures a lateral evasion of the longer plate in two different stable states which constitute the two switch states. The two oblong plates of the single springs can braced by means of a stamping on one of the two plates which leads to the shortening thereof.

The change between the two stable states can advantageously be realized via actuators in the form of wires 318, 319 made from shape memory material that change their length as a result of a flow of current and the resultant heating and that are arranged on both sides of the snap-action spring. One end of the shape memory elements can be secured on the underside of the relay to the base.

However, the actuation can also be performed by electromagnetic coils.

The two single springs 302, 302' constitute in each case the centre contact of a changeover switch contact arrangement. They carry on both sides a contact dot 314, 314' and each move between two fixed contacts 320.

On the underside the single spring 302, 302' is electrically connected externally by a soldered connection 321, 321' or a plug-type connection of the relay.

The mobile centre contacts on the snap-action spring find their opposite contacts in the two stable states of the snap-action spring. These fixed opposite contacts are electrically connected to corresponding soldering pins or plug-type connections on the outside of the relay.

Figure 20:
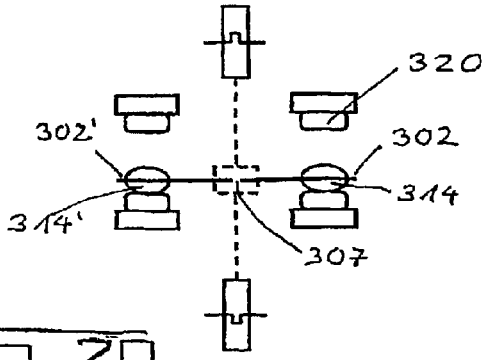
FIG. 20 shows a schematic view of the contact arrangement of the snap-action spring according to FIG. 18.
Figure 21:
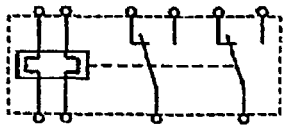
FIG. 21 shows an equivalent electrical circuit diagram for the snap-action spring that can be used as a polarity reversing switch with drive elements according to FIG. 18.

The presence of two electrically separated single springs, which nevertheless form one unit mechanically, and of the described contact arrangement resulting in a connected double change-over contact, as shown in FIGS. 20 and 21. This is relatively simple and in particular very inexpensive to complete, e.g. into a motor polarity reversing switch.

What is claimed is:

1. A bi-stable electric switch comprising:

a spring that is configured as a bi-stable snap-action spring and carries at least one electrical contact element on a region of the spring;

at least two drive elements made from shape memory material coupled to the region of the spring for actuating the spring;

at least one plate located in the region of the spring that is subjected to a pressure in the direction of its linear extension; the plate bulges towards one side into one of two stable final states to relieve the pressure;

whereby the region of the spring in the stable final states takes up different lateral positions and the drive elements act upon the plate and as a result of the change of position of the plate causing the plate to snap into the second stable final state; and wherein the spring is rigidly fixed at one end and free at the other end, the drive elements being configured to act upon the free end of the plate tilting the free end to cause the spring to snap into another stable final state.

2. The bi-stable electric switch according to claim 1, wherein wires having different lengths in the different phases are used as drive elements.

3. The bi-stable electric switch according to claim 2, wherein a transition from one into the other phase of the wires occurs as a result of rise in temperature.

4. The bi-stable electric switch according to claim 3, wherein the rise in temperature is achievable as a result of an electric current flowing through the wire.

5. The bi-stable electric switch according to claim 1 wherein the spring is configured as a flat-form spring.

6. A bi-stable electric switch, comprising;

a spring that is configured as a bi-stable snap-action spring and carries at least one electrical contact element on a region of the spring, the spring being configured as a flat-form spring having, arranged substantially in parallel to one another, a plurality of plates which are connected to one another at their ends and in that one or more plates are elongated or shortened by plastic deformation;

at least two drive elements made from shape memory material coupled to the region of the spring for actuating the spring;

at least one plate located in the region of the spring that is subjected to a pressure in the direction of its linear extension; the plate bulges towards one side into one of two stable final states to relieve the pressure;

wherein the region of the spring in the stable final states takes up different lateral positions and the drive elements act upon the plate and as a result of the change of position of the plate cause the plate to snap into the second stable final state.

7. The bi-stable electric switch according to claim 6, wherein the plastic deformation is a stamping.

8. The bi-stable electric switch according to claim 1, wherein the contact element is electrically connected to the spring.

9. A bi-stable electric switch comprising:

a spring that is configured as a bi-stable snap-action spring and carries at least one electrical contact element on a region of the spring, the spring being configured as a trapezoidal spring that is subdivided into three plates by slots;

at least two drive elements made from shape memory material coupled to the region of the spring for actuating the spring;

at least one plate located in the region of the spring that is subjected to a pressure in the direction of its linear extension; the plate bulges towards one side into one of two stable final states to relieve the pressure;

whereby the region of the spring in the stable final states takes up different lateral positions and the drive elements act upon the plate and as a result of the change of position of the plate causing the plate to snap into the second stable state.

10. The bi-stable electric switch according to claim 8, wherein the width of the plates widens in a constant ratio from a narrow side to a wide side.

11. A bi-stable electric switch, comprising:

a spring configured as a bi-stable snap action spring having at least one plate subjected to a compressive pressure in the direction of its linear extension causing the plate to bulge laterally into one of two stable final states; the spring carrying at least one electrical contact element on a region of the spring; and at least two drive elements made from shape memory material coupled to the region of the spring for actuating the spring;

wherein the region of the spring takes different lateral positions in each of the two stable final states, and a corresponding one of the drive elements is configured to act upon the plate to snap it into the opposite stable final state.

* * * * *